US007325628B2

(12) United States Patent
Brunning et al.

(10) Patent No.: US 7,325,628 B2
(45) Date of Patent: Feb. 5, 2008

(54) ANCHOR FOR VEHICLE, VEHICLE AND ANCHOR IN COMBINATION, AND METHOD OF USING THE ANCHOR

(75) Inventors: Paul J. Brunning, Inverurie (GB); David G. F. McKay, Aberdeen (GB)

(73) Assignee: Acergy UK Limited, Aberdeen (GB)

( * ) Notice: Subject to any disclaimer, the term of this patent is extended or adjusted under 35 U.S.C. 154(b) by 265 days.

(21) Appl. No.: 10/499,469

(22) PCT Filed: Dec. 20, 2002

(86) PCT No.: PCT/GB02/05841

§ 371 (c)(1),
(2), (4) Date: Dec. 22, 2004

(87) PCT Pub. No.: WO03/053773

PCT Pub. Date: Jul. 3, 2003

(65) Prior Publication Data

US 2005/0103252 A1 May 19, 2005

(30) Foreign Application Priority Data

Dec. 20, 2001 (GB) ..... 0130447.6

(51) Int. Cl.
*E21B 7/132* (2006.01)
*E21B 49/02* (2006.01)
*B63B 21/26* (2006.01)

(52) U.S. Cl. ..... 175/8; 175/40; 175/58; 405/203; 114/295

(58) Field of Classification Search ..... 175/5–10, 175/40, 58; 114/295–311; 405/203, 224, 405/226–228; 166/358, 360, 354, 196
See application file for complete search history.

(56) References Cited

U.S. PATENT DOCUMENTS 2,960,832 A * 11/1960 Hayward ..... 405/227

(Continued)

FOREIGN PATENT DOCUMENTS

FR 2 363 474 3/1978

(Continued)

*Primary Examiner*—Kenneth Thompson
(74) *Attorney, Agent, or Firm*—Sheridan Ross P.C.

(57) ABSTRACT

A seabed anchor (20) is fixed to and deployable from an ROV (10) for positively anchoring the ROV (10) to the seabed (100). The seabed anchor (20) comprises three nested telescoping tubes (26, 28, & 30). The upper end of the oute (26) is fixed to the ROV (10). A rotary drill bit (38) is carried on the output shaft of a motor (34) that is mounted o of the innermost tube (30). The nested assembly of three telescopic tubes (26, 28, 30) can be controllably extended and retracted b controlled operation of a hydraulic ram or other linear actuator coupled between the outer tube (26) and the inner tube (30). Each the tubes (26, 28 & 30) carries a respective one or two pairs of inflatable packets (40, 42, & 44) that are normally un quiescent within respective recesses in the sides of the tubes where the packers do not interfere with telescopic relative movements of the tubes. To set the seabed anchor (20), the drill bit (38) is rotated and forced downwards into the seabed (100) to form When the bore is at its full depth, the packers (40, 42, & 44) are inflated to force the packers into penetrating engagement with t seabed (100) surrounding the bore, thereby anchoring the ROV (10) to the seabed (100). The seabed anchor (20) allows th (10) to be firmly anchored onto the seabed (100) to resist upward reaction forces arising from ROV-carried geotechnical tools and/o sensors (e.g. a soil sampling tool) being made to penetrate the seabed (100). The seabed anchor (20) is particularly useful for ROV which are neutrally buoyant or slightly positively buoyant, and which therefore have negligible weight (when fully submerged) for holding them down onto the seabed against upward reaction forces.

45 Claims, 4 Drawing Sheets

U.S. PATENT DOCUMENTS

| | | | | | |
|---|---|---|---|---|---|
| 3,433,531 | A | * | 3/1969 | Koot et al. | 299/8 |
| 3,799,260 | A | * | 3/1974 | Barrington | 166/185 |
| 3,858,441 | A | | 1/1975 | Comeau | |
| 4,039,025 | A | * | 8/1977 | Burkhardt et al. | 166/360 |
| 4,127,991 | A | * | 12/1978 | Regan | 405/202 |
| 4,216,835 | A | * | 8/1980 | Nelson | 175/10 |
| 4,312,289 | A | | 1/1982 | Conrad | |
| 4,682,559 | A | * | 7/1987 | Schnitzer et al. | 114/295 |
| 4,702,047 | A | | 10/1987 | Stokes | |
| 5,570,975 | A | | 11/1996 | Reinert, Sr. | |
| 6,119,618 | A | | 9/2000 | Giles | |
| 6,167,831 | B1 | | 1/2001 | Watt et al. | |
| 6,223,671 | B1 | | 5/2001 | Head | |

FOREIGN PATENT DOCUMENTS

| | | |
|---|---|---|
| GB | 2 106 849 | 4/1983 |
| GB | 2343667 | 5/2000 |
| WO | WO 91/06713 | 5/1991 |
| WO | WO 99/42357 | 8/1999 |

* cited by examiner

ANCHOR FOR VEHICLE, VEHICLE AND ANCHOR IN COMBINATION, AND METHOD OF USING THE ANCHOR

INTRODUCTION

This invention relates to an anchor for a vehicle, and relates more particularly but not exclusively to an anchor for a survey vehicle. Particular embodiments of the invention provide a seabed anchor carried by and deployed from a neutrally buoyant or positively buoyant ROV (Remotely Operated Vehicle) for the purpose of anchoring the ROV to the seabed.

Construction in any environment requires survey work, including measurements of soil mechanics and other geotechnical investigations. As the geographical distribution of offshore oil and gas exploration and production extends to ever-deeper water, there is an associated requirement for geotechnical and geophysical investigations to be accomplished by remote operations on the seabed. Conventional geotechnical investigation procedures rely on surface-floating vessels for deployment of equipment for sampling and testing. At present, the handling of submerged geotechnical investigatory tools becomes problematic in water depths that are greater than 1500 metres, primarily from difficulties associated with the rigging due to the extreme length of umbilicals and lift wires extending from the surface vessel to the tools at seabed depths. A further problem arises from the reducing accuracy of tool positioning with increasing depth. Even when operating in relatively shallow water, geotechnical investigatory tools suspended from cable(s) and/or umbilical(s) are unsafe to operate in close proximity to existing installations, and are unable to operate for example directly under offshore platforms. As an alternative to the direct deployment of geotechnical investigatory equipment from surface vessels, it is possible to use stand-alone remotely-operated geotechnical investigatory equipment attached to an ROV, that is to carry the equipment on a robotic submarine, with the equipment and submarine both being controlled by a remote operator such as a technician in a surface-floating ship. Remotely controlled vehicles are also of interest in surveying in hostile and constricted environments of many types, both natural and man-made.

A particular problem in developing ROV-based operating systems for seabed geotechnics is that ROVs are usually neutrally buoyant or slightly positively buoyant or no more than slightly negatively buoyant. Consequently, when the ROV is fully submerged, the ROV has an inherent lack of net downward weight sufficient to provide the reaction forces necessary for pushing geotechnical sampling tools and sensors into the seabed (e.g. for in situ soil testing). Possible technical solutions to this problem can include the use of thrusters, or the application of ballasting weights to the ROV, or the use of seabed anchoring. The applicant knows of (unpublished) attempts by others to achieve reliable seabed anchoring of ROVs for geotechnical survey, but these have not been at all successful. The same or similar problems apply to manned underwater vehicles, and to vehicles or other entities that cannot rely on their own weight for self-anchoring or for anchor setting (whether or not the vehicle or other entity is submerged in water). Similar problems arise on other types of ground, be it seabed or "dry land". Although, on land, providing a heavy platform for the tool is generally a sufficient solution, this will not always be desirable. Survey operations on bodies of ice and even extra-terrestrial bodies may also be envisaged, and the term "ground" as used herein is to be understood as encompassing these also.

It is therefore an object of the invention to provide an anchor that can be deployed by a vehicle such as a survey vehicle, for example to provide a reaction force for geotechnical investigations. In the context of this specification, the term "vehicle" will be used in a broad sense to encompass vehicles and any movable platform or other entity, whether manned or unmanned, and whether or not the vehicle is an autonomous vehicle.

According to first aspect of the present invention there is provided an anchor for use on a vehicle, the anchor comprising drill means operable to drill into ground adjacent to the vehicle to form a hollow bore in the ground, the anchor further comprising ground-engaging means operable within the bore formed by the drill means to extend laterally to engage the ground and thereby to resist withdrawal of the anchor from the bore.

The anchor may be specifically adapted for underwater use, the ground in that case comprising seabed or the like. The anchor may alternatively or in addition be adapted for use in arctic, or extra-terrestrial environments.

The ground-engaging means may be integral with the drill means.

The drill means and the ground-engaging means may be co-operable so as to avoid the need to retract the drill means from the bore prior to inserting the ground-engaging means. Depending on the soil type, it will be appreciated that the bore may deform or collapse upon withdrawal of the drill, preventing successful deployment of the ground-engaging means.

In a first such embodiment, the drill means and the ground-engaging means are adapted to enter and remain together in the bore while the ground-engaging means is deployed to engage the wall of the bore. In a second such embodiment, the drill means is adapted to be withdrawn, leaving the ground-engaging means to engage the wall of the bore. The ground-engaging means may be arranged to travel into the bore during drilling, or after drilling, but prior to withdrawal of the drill means.

The drill means preferably comprises a rotary drill bit and a drill-driving rotary motor coupled to the drill bit, the drill-driving rotary motor conveniently being a hydraulic motor powered in use by pressurised liquid. The motor may be located at the extremity of the drill means, such arrangements being well-known in the offshore drilling art.

In a version adapted for underwater use, the hydraulic liquid may be ambient water (seawater in most cases). Where the driving motor is hydraulic and is operable by pressurised water supplied to the motor, the water leaving the motor after powering the motor may be discharged in a manner tending to flush drilling debris away from the drill bit and out of the bore being drilled by the drill means.

The ground-engaging means may comprise one or more flexible packers or flexible membranes normally quiescent in a deflated configuration and inflatable to extend laterally into engagement with the ground around the bore in which the ground-engaging means is deployed. Inflation of the one or more flexible packers or flexible membranes may be accomplished by controlled admission of pressurised fluid. This fluid again may be ambient water. As an alternative or addition to inflatable packers or membranes, the ground-engaging means may comprise one or more mechanical packers or flukes or wedges, the or each of which is displaceable from a respective normally quiescent position withdrawn from substantial engagement with the wall of the bore in which the ground-engaging means is deployed, to a respective laterally extended position so as to engage the ground around the bore. The ground-engaging means is preferably disposed to engage the bore at a plurality of locations distributed circumferentially around and/or axially along the bore within which the ground-engaging means is deployed in use.

Positive withdrawal means may be provided for controllably effecting positive withdrawal of the ground-engaging means from substantial engagement with ground around the bore in which the ground-engaging means is deployed as a stage in withdrawal of the anchor from the ground, whereby to obviate or minimise risk of the anchor remaining stuck in the seabed. Positive withdrawal is considered more reliable than dependence on springs or gravity for withdrawal of flukes or whatever other ground-engaging means is laterally deployed.

The ground engaging-means are preferably disengagable by remote control, for selective release of the anchor from the ground. The anchor may in particular provide for use (deployment and subsequent retraction) at a succession of locations without contemporary human intervention, e.g. by suitable programming of an on-board computer controlling exploration by an ROV or other vehicle on which the anchor is operatively mounted. In such a case the anchor may be provided with remotely operable decoupling means or a simple "weak link" for decoupling the vehicle from the anchor in the event that the anchor should fail to disengage from the seabed or other ground in which the anchor is engaged.

In alternative embodiments, parts of, or even the whole of, a anchor in accordance with the invention may be constructed or adapted for selective abandonment in the ground to allow departure of the vehicle from a location at which the vehicle was previously anchored by that anchor.

The anchor may be provided with alternative forms of ground-engaging means together with substitution means for substituting these alternative forms according to ground type and intended application of the vehicle.

The anchor of the first aspect of the present invention may be supplied as a prefabricated unit for retrofitting to a pre-existing vehicle. Alternatively, the anchor of the first aspect of the present invention may be supplied as a kit of parts for assembly onto a pre-existing vehicle. The anchors may be supplied in sets of two or three anchors for fitting to a vehicle at selected spaced-apart locations thereon. The or each anchor may incorporate its own power supply; alternatively, the or each anchor may be constructed or adapted to receive its normal operating power from the vehicle to which the anchor is retrofitted.

According to a second aspect of the invention there is provided a combination of a vehicle with an anchor comprising drill means operable to drill into ground adjacent the vehicle to form a hollow bore in the ground, the anchor further comprising ground-engaging means operable within the bore formed by the drill means to extend laterally to engage the ground and thereby to resist separation of the vehicle from the ground.

The vehicle may comprise a survey vehicle including at least one investigatory tool deployable against the ground using reaction force provided by the anchor.

The investigatory tool may comprise an instrument operable to measure mechanical properties of the ground. The investigatory tool may comprise a sampling tool, the ground properties being measured by analysis of a sample of ground material recovered by the tool. Measurement of ground properties may be augmented or substituted by measurement of the power or energy or force required to cause the ground-engaging means laterally to extend from within a bore to engage ground around the bore formed and occupied by the anchor; for example, cohesion of the soil may be inferred from the pressure necessary to inflate inflatable packers constituting the laterally extendible ground-engaging means.

Accordingly, said anchor may include instrumentation for outputting information on conditions within the bore formed by the drill means.

The vehicle is preferably combined with a plurality of such anchors that are mutually spaced apart to anchor the vehicle to adjacent ground at a corresponding plurality of spaced-apart locations and thereby increase the resistance of the vehicle to toppling in response to upward reaction forces arising from use of geotechnical investigatory tools or sensors mounted on the vehicle. Hydraulic power and/or other forms of power for operating the or each anchor or parts thereof may be obtained from a power supply or supplies forming an integral part of the vehicle (e.g. a seawater pump driven by an electric motor powered by batteries on board an ROV or powered by electricity delivered to an ROV via a cable). The or each said anchor is preferably an anchor according to the first aspect of the present invention. The anchor(s) preferably provide a reaction force greater than can be provided by any upwardly discharging propulsive/manoeuvring thrusters mounted on the ROV or other vehicle, or by vehicular weight alone.

The vehicle may comprise a remotely operated vehicle (ROV) adapted for seabed operation.

According to a third aspect of the present invention there is provided a method of anchoring a vehicle to adjacent ground, the method comprising the steps of providing the vehicle with an anchor having drill means and ground-engaging means, operating the drill means of the anchor to drill into ground adjacent the vehicle to form a hollow bore in the adjacent ground, and then operating the ground-engaging means within said bore to engage the ground thereby to anchor the vehicle to the ground.

Said vehicle may be an underwater ROV (Remotely Operated Vehicle), but the vehicle may also be a manned submersible, or a variable buoyancy lifting body, or any other mobile entity.

The method may be performed without retracting the drill means from the bore formed by the drill means, prior to inserting the ground-engaging means into said bore. In a first such embodiment, the drill means and the ground-engaging means enter and remain together in the bore while the ground-engaging means is deployed to engage the wall of the bore. In a second such embodiment, the drill means is withdrawn, leaving the ground-engaging means to engage the wall of the bore. The ground-engaging means may travel into the bore during drilling, or after drilling, but in either case, preferably prior to withdrawal of the drill means from the bore formed by the drill means.

The vehicle may be provided with a plurality of such anchors that are mutually spaced apart to anchor the vehicle to adjacent ground at a corresponding plurality of spaced-apart locations. Hydraulic power and/or other forms of power for operating the or each anchor or parts thereof may be provided to the or each anchor from a power supply or supplies forming an integral part of the vehicle (e.g. a seawater pump driven by an electric motor powered by batteries on board an ROV (or other vehicle), or powered by electricity delivered to the ROV (or other vehicle) via a cable). The or each said anchor is preferably an anchor according to the first aspect of the present invention.

The method may further comprise a step of performing a measurement of ground properties at a selected location on the ground using a geotechnical investigatory tool carried by the vehicle to the selected location, the vehicle then being anchored to the ground at the selected location, and the investigatory tool being driven into the ground against a reaction force provided by the anchor(s).

The method may further include deriving measurements of geotechnical properties of the ground from measurements of parameters of the ground-engaging means, during deployment thereof.

In a further aspect of the invention there is provided ground engaging means comprising a bladder wherein pressure applied to said bladder in a longitudinal direction results in expansion of the bladder in a transverse direction and therefore engaging with the ground.

Said bladder may be actuable by a ram, said ram extending into and being attached to a lower part of said bladder and wherein when a force is applied to move said ram in an upward direction, the bottom of said bladder moves upwards relative to the top of the bladder resulting in the body of the bladder extending radially thus engaging the ground.

Said bladder may be cylindrical in shape, with steel cap bottom and top, the latter cap having a hole to allow the ram to extend into the bladder.

BRIEF DESCRIPTION OF THE DRAWINGS

Embodiments of the invention will now be described, by way of example only, with reference to the accompanying drawing wherein.

DETAILED DESCRIPTION OF EXEMPLARY EMBODIMENTS

Figures 1, 2:
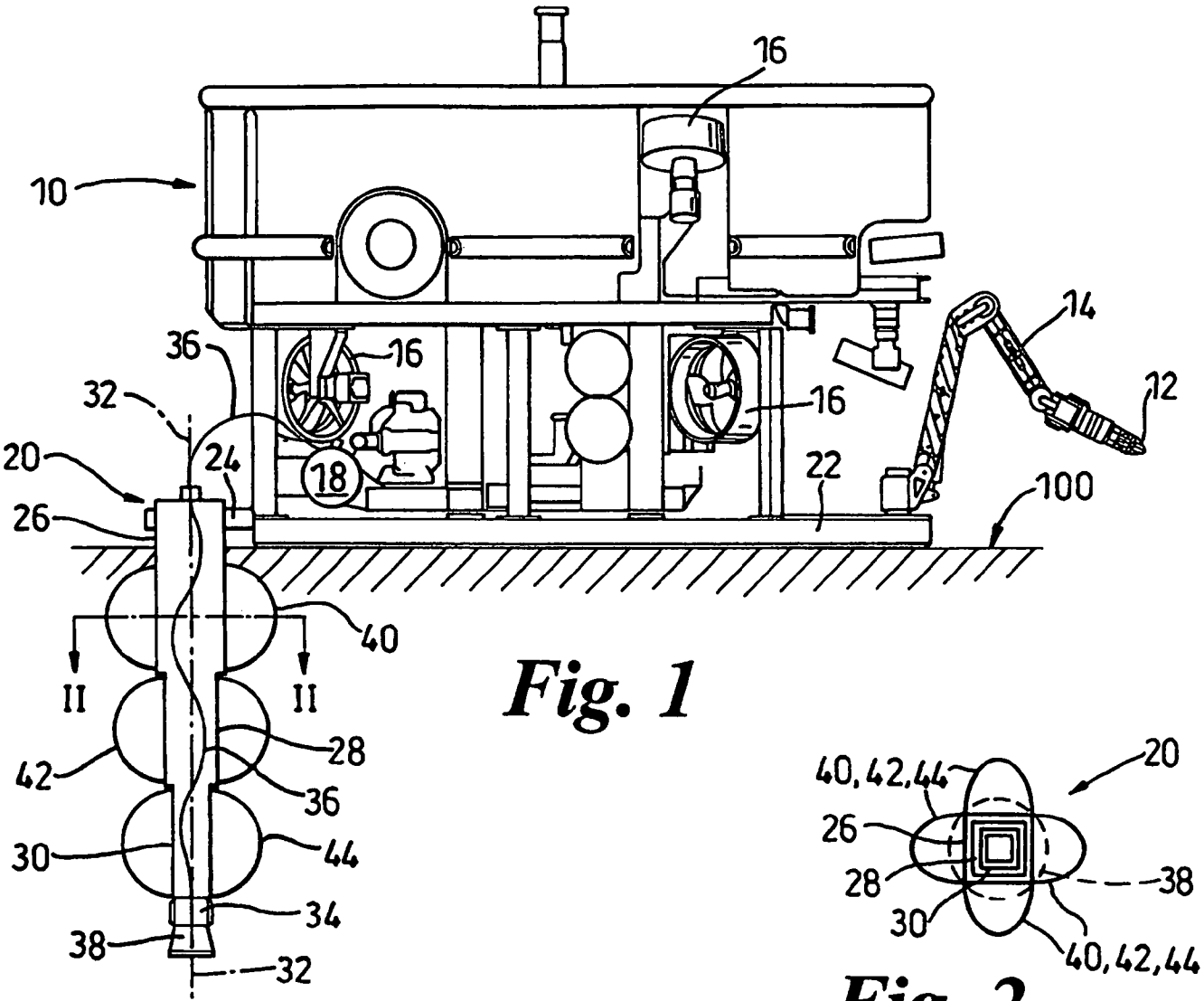
FIG. 1 is a part-sectional elevation of an ROV fitted with a first embodiment of a seabed anchor in accordance with the invention and in use to anchor the ROV to adjacent seabed.
FIG. 2. is a transverse cross-section in a horizontal plane of the seabed anchor of FIG. 1, the section being taken on the line II-II in FIG. 1.

Referring first to FIG. 1, this shows an ROV 10 resting on seabed 100 (only the uppermost part of the seabed 100 being specifically depicted for the sake of clarity). The ROV 10 is a remotely operable submarine vehicle that is of known form, and is conventional other than for the addition of one or more seabed anchors, as will subsequently be described. Stolt Offshore's "SCV3000" type of ROV is suitable, for example. As is common for conventional ROVs, the ROV 10 is neutrally buoyant or slightly positively buoyant such that notwithstanding the considerable weight of the ROV when suspended above the surface of the sea, the ROV 10 presents no static downward force on the seabed 100 when the ROV 10 is resting thereon. The ROV 10 is intended to force geotechnical investigatory tools or sensors (not shown per se) into the seabed 100, for example, by gripping a tool or sensor in a gripper 12 on the outboard end of a manipulator 14 with which the front end the ROV 10 is equipped, and then ramming the gripped tool or sensor downwards into the seabed 100. (The gripper 12 may be removed and substituted by a suitable adapter (not shown) for directly mounting the tool or sensor on the manipulator 14 in place of the gripper 12.) This downward force on the tool or sensor results in an upward reaction force on the manipulator 14 that requires to be countered, or else the ROV 10 will be forced upwards off the seabed 100 with the undesirable consequence that the tool or sensor will not properly penetrate the seabed 100. Since the ROV 10 is neutrally or positively buoyant, the mass of the fully submerged ROV 10 is not available in the form of downwardly acting weight that would adequately counter the upward reaction force. (It is to be noted that although only one manipulator 14 is visible in FIG. 1, the "SCV3000" ROV shown by way of example has two such manipulators, with one being mounted on or closely adjacent each of the laterally opposite front corners of the ROV 10, such that in the side view of FIG. 1, the port manipulator is concealed behind the visible starboard manipulator. The alternative use of a single manipulator or of two mutually spaced-apart manipulators for handling of geotechnical investigatory tools or sensors and for causing the tools or sensors to penetrate the seabed 100 may alter the horizontal position of upward reaction force relative to the ROV 10 as a whole, but does not obviate the need to withstand upward reaction force.)

The ROV 10 is equipped with several steerable thrusters 16 by which the ROV 10 can be controllably propelled in any selected direction while underwater, and these thrusters 16 could theoretically be used to hold the ROV 10 downwards onto the seabed 100 against the up-thrusting reaction forces resulting from use of the geotechnical investigatory tool. However, such use of the thrusters 16 would consume considerable power, and the forces that can be supplied by the thrusters 16 are limited. Moreover, use of the thrusters 16 for station-keeping requires careful balancing of dynamic forces, and does not maintain position in a positive manner. In order to overcome these problems, the ROV 10 is fitted with a seabed anchor 20 that will now be described in detail.

As illustrated in FIG. 1, one seabed anchor 20 is mounted outboard of the base 22 of the ROV 10 by means of an anchor mounting bracket 24 extending rearwards from the ROV base 22. The seabed anchor 20 is shown attached to the end of the ROV 10 opposite the manipulator 14 for clarity and by way of example only. In practice, if only a single seabed anchor 20 is fitted to the ROV 10 and only the illustrated manipulator 14 is used, the single seabed anchor would preferably be affixed to the ROV 10 close to or directly under the mounting of the manipulator 14 to minimise tipping of the ROV that would be induced if the upward reaction force and the downward anchoring force were horizontally offset. However, it is preferred that rather than fit only a single seabed anchor 20 to the ROV 10, the front end of the ROV be fitted with a pair of seabed anchors with one anchor at or near each front corner and substantially directly under a respective one of the two corner-mounted manipulators at the front end of the "SCV3000" ROV. It is further preferred additionally to have a third seabed anchor mounted about the middle of the rear end of the ROV (e.g. somewhat as illustrated), such that the ROV would then have near-optimally distributed three-point anchoring and therefore be particularly stable against disturbances induced by seabed investigations.

For the sake of simplicity, the bracket 24 is illustrated in a semi-schematic form that omits various structural details. FIG. 1 shows the seabed anchor 20 in its downwardly extended configuration ready for use as an anchor for the ROV 10. Not shown in FIG. 1 is means on and adjacent the bracket 24 by which the seabed anchor 20 can be retracted vertically upwards away from its illustrated operating configuration, to a safe configuration in which even the lowest part (the cutter 38) of the unextended anchor 20 is situated above the lower face of the ROV base 22. In this vertically retracted configuration, all parts of the anchor 20 will be held above the deck (not shown) of a support vessel (not shown) from which the ROV 10 is deployed in use. As an alternative to vertically lifting the anchor 20 to a 'safe' position in which the anchor will not collide with a deck or other structure on which the ROV 10 may be placed, the bracket 24 may be constructed or adapted to rotate the anchor 20 in a vertical plane about its point of attachment to the bracket 24 so as to swing the anchor 20 upwards to a 'safe' position.

The seabed anchor 20 comprises a nested triplet of mutually telescoping hollow tubes 26, 28, and 30 that are square in cross-section (see FIG. 2). A combination of interacting external and internal flanges (not shown in detail) at the ends of the tubes 26, 28, & 30 limits maximum telescopic extension and prevents these tubes becoming mutually separated. The upper end of the outer tube 26 is fixed to the end of the bracket 24, with the common longitudinal axis 32 of the three tubes 26, 28, & 30 directed downwards at right angles to the general plane of the ROV base 22. A down-hole hydraulic motor 34 is mounted on the lower end of the inner tube 30, with the motor output shaft (not shown) rotating about a vertical axis that is coaxial with the longitudinal axis 32. The motor 34 in this example is powered by ambient seawater which is pressurised by an electrically-driven pump 18 on board the ROV 10, and which is delivered from the pump 18 to the motor 34 through a flexible hose 36 extending down the hollow interior of the nested tubes 26, 28, & 30. (The pump 18 is part of the standard equipment of the ROV 10.) A rotary drill bit 38 is mounted on the output shaft of the motor 34 to be rotated thereby at times selected by the remote operator of the ROV 10. The drill bit 38 is a conventional rotary drill bit selected for best drilling performance in compacted sediments and soft rock. Seawater exhausting from the motor 34 is preferably discharged through one or more nozzles (not shown) directed to clear drilling debris away from the drill bit 38 and upwards out of the bore drilled by the bit 38 in the seabed 100. The housing of the motor 34 is prevented from counter-rotating in reaction to drilling torque because the motor 34 is fixed to the lower end of the inner tube 30, because the square cross-section of the telescoping tubes 26, 28, & 30 (see FIG. 2) prevents relative rotation of these tubes, and because of the fixed attachment of the outer tube 26 to the bracket 24 that is, in turn, fixed to the ROV base 22. The thrusters 16 will provide counter-rotary forces on the body of the ROV 10 to prevent it rotating and to provide necessary reaction for torque applied to the drill bit 38. It should be noted from FIG. 2 that the outside diameter of the drill bit 38 is substantially equal to the maximum transverse width of the outer tube 26, i.e. the diagonal dimension of the square tube 26, such that the tube 26 (and also the smaller tubes 28 & 30) will transversely fit within the nominal diameter of a hole drilled by the bit 38.

The telescopic tubes 26, 28, & 30 are each fitted with one or two pairs of diametrically opposed inflatable packers 40, 42, & 44 respectively. The packers 40, 42, & 44 are normally un-inflated and lie flat within recesses (not shown) in the sides of the tubes 26, 28, & 30 where the packers do not interfere with telescoping movements of these tubes. When required, the packers 40, 42, & 44 can be inflated under the control of the remote (surface) operator of the ROV 10 so as to extend laterally into penetrating engagement with the seabed 100 around the bore drilled and occupied by the seabed anchor 20, as shown in FIGS. 1 and 2. Inflation of the packers 40, 42, & 44 is conveniently achieved by filling the packers with pressurised liquid, e.g. with pressurised ambient seawater that can be obtained from remotely controlled operation of the pump 18, with controlled diversion of the pump output from the motor 34 to the packers. The area of the packers 40, 42, & 44 that contacts the seabed material is preferably maximised in order to maximise anchoring performance attributable to friction between these packers and the seabed material engaged by the packers. Remotely controlled deflation of the packers 40, 42, & 44 as a first stage in unsetting of the seabed anchor 20 can be achieved by selectively venting the packers to ambient, and allowing natural elasticity of the packers to cause their collapse back into the recesses in the sides of the tubes 26, 28, & 30 in which they are respectively mounted. If necessary or desirable, suitable provision can be made to cause positive collapse of the packers 40, 42, & 44 upon their deflation.

When the ROV 10 is deployed from a surface vessel (not shown) and navigated to a location on the seabed 100 selected for the performance of a geotechnical investigation using tools and/or sensors carried by the ROV 10, the ROV 10 is manoeuvred by suitable operation of the thrusters 16 to set down on the seabed 100, and to remain there until reliably anchored by the procedure about to be described. Initially the tubes 26, 28, & 30 of the seabed anchor 20 are fully telescoped such that the anchor 20 has a minimal longitudinal (vertical) extent. To initiate anchor-setting, the power-driven water pump 18 is started up by a command from the remote (surface) operator of the ROV 10, and seawater drawn through a filter (not shown) from ambient around the ROV 10 is pressurised in the pump 18, then fed via distributive manifolds, pipework and control valves (not shown) through the hose 36 to the motor 34. Hydraulic energisation of the motor 34 causes its output shaft to rotate, and consequently the drill bit 38 commences to rotate. The seabed anchor 20 is urged to extend downwards by suitable pressurisation of a hydraulic ram (not shown) or other form of linear actuator extending between the fixed upper end of the outer tube 26 and the longitudinally movable lower end of the inner tube 30, the intermediate tube 28 longitudinally floating between the outer tube 26 and the inner tube 30.

The combination of powered rotation of the drill bit 38 and downward urging of the lower end of the tube 30 on which the drill-bit-driving motor 34 is mounted result in a bore being drilled downwards into the seabed 100. When the bore reaches its maximum depth (i.e. when the combination of the three mutually telescoping tubes 26, 28, & 30 is extended as much as is possible without mutually detaching them), rotation of the drill bit 38 is halted by terminating supply to the motor 34 of pressurised water from the pump 18. Meanwhile, pressurisation of the ram or other linear actuator urging downward extension of the seabed anchor 20 into the seabed 100 is maintained. As a final stage in setting of the seabed anchor 20, the packers 40, 42, & 44 are inflated (as previously detailed) so as to force the packers into penetrating contact with seabed 100 surrounding the bore drilled and currently occupied by the anchor 20, as shown in FIGS. 1 & 2. Inflation of the packers 40, 42, & 44 thereby causes the anchor 20 to become firmly embedded in the seabed 100, and serves to anchor the ROV 10 to the seabed 100 without further operation of the thrusters 16 hitherto dynamically holding the ROV 10 onto the seabed 100 until the seabed anchor 20 was fully deployed and embedded in the seabed 100. The ROV 10 can then deploy the geotechnical investigatory tools and/or sensors and force their penetration downwards into the seabed 100 without the upward reaction to the downward penetrating force causing the ROV 10 to become lifted off the seabed 100. Thrusters 16 need not be powered to provide this reaction force, and indeed the reaction force can exceed the force achievable by the thrusters alone. Information gained from use of these tools and/or sensors can be augmented by recording the pressure and volume of water required to inflate the packers 40, 42, & 44 to their maximum or other selected extent.

At the conclusion of the geotechnical tests, the seabed anchor 20 is unset by deflation of the packers 40, 42, & 44, followed by telescopic retraction of the intermediate and inner tubes 28 and 30 upwards and fully into the fixed outer tube 26 by reverse operation of the hydraulic ram or other linear actuator previously employed for downward extension of the tubes into the seabed 100 as the bore was drilled. (If the bore has collapsed around the drill bit 38, the motor 34 can be temporarily powered and pulled upwards to effect reverse reaming of the bore so as to widen the bore sufficiently to allow withdrawal of the anchor 20 fully out of the seabed 100.) When the seabed anchor 20 has been fully unset and withdrawn from the seabed 100, the ROV 10 becomes free to be moved to the location of its next desired geotechnical test, or back to the surface-floating vessel from which the ROV 10 was initially deployed.

Modifications and variations of the above-described embodiment can be adopted without departing from the scope of the invention. For example, in place of the inflatable packers 40, 42, & 44 it would be possible to employ suitable inflatable membranes, or to employ mechanical anchoring flukes or wedges laterally extendable from the telescopic tubes by any suitable remotely controllable means, whether hydraulic, non-hydraulic, mechanical, or non-mechanical.

As an alternative to the drill arrangement illustrated in FIG. 1, a modified form of seabed anchor 220 (illustrated in the highly schematic FIGS. 3A-3E) uses a drill 222 that is retractable separately from the packer assembly of the anchor 220. FIGS. 3A-3E schematically illustrate successive stages in the deployment of this second embodiment 220 of seabed anchor, with FIG. 3A showing the anchor 220 fully retracted by one side of an ROV 210 on which the anchor 220 is mounted for controlled deployment and anchoring of the ROV 210, and FIGS. 3B-3E (detailed below) showing the successive stages in the deployment of the anchor 220.

Referring first to FIG. 3A, this alternative arrangement of drill 222 has the form of a hollow cylindrical tube 224 dimensioned to surround an assembly 226 of telescopic tubes together with inflatable packers 228. The tube 224 has its lower end formed as or fitted with a radially narrow annular cutter 230, i.e. a cutter shaped and dimensioned to cut a ring-shaped circular slot slightly larger than required for the tube 224 to slide longitudinally into. This axially extended tubular drill 222 is rotated by a suitable hydraulic motor 232 whose rotor is coupled to and rotatably mounts the upper end of the tube 224, the axis of rotation of the tubular drill 222 being the longitudinal axis of the tube 224 and coaxial with the longitudinal axis 32 of the tube/packer assembly 226/228. The stator of the hydraulic motor 232 is mounted on the outboard end of a bracket 234 that extends from a vertically adjustable mounting 236 secured to an ROV 210. Controlled operation of the mounting 236 raises or lowers the bracket 234 while maintaining the bracket 234 substantially horizontal with respect to the ROV 210 when the ROV 210 is upright. This purely vertical and non-tilting movement of the bracket 234 correspondingly raises or lowers the stator of the hydraulic motor 232, in turn raising or lowering the rotor of the hydraulic motor 232 and with it, the tubular drill 222.

The tube/packer assembly 226/228 is non-rotatably mounted independently of the rotatable and vertically movable tubular drill 222 by means of being mounted on the outboard end of a bracket 238 that extends from a vertically adjustable mounting 240 secured to an ROV 210. Controlled operation of the mounting 240 raises or lowers the bracket 238 while maintaining the bracket 238 substantially horizontal with respect to the ROV 210 when the ROV 210 is upright. This purely vertical and non-tilting movement of the bracket 238 correspondingly raises or lowers the tube assembly 226 and with it, the packers 228.

Figure 3B:
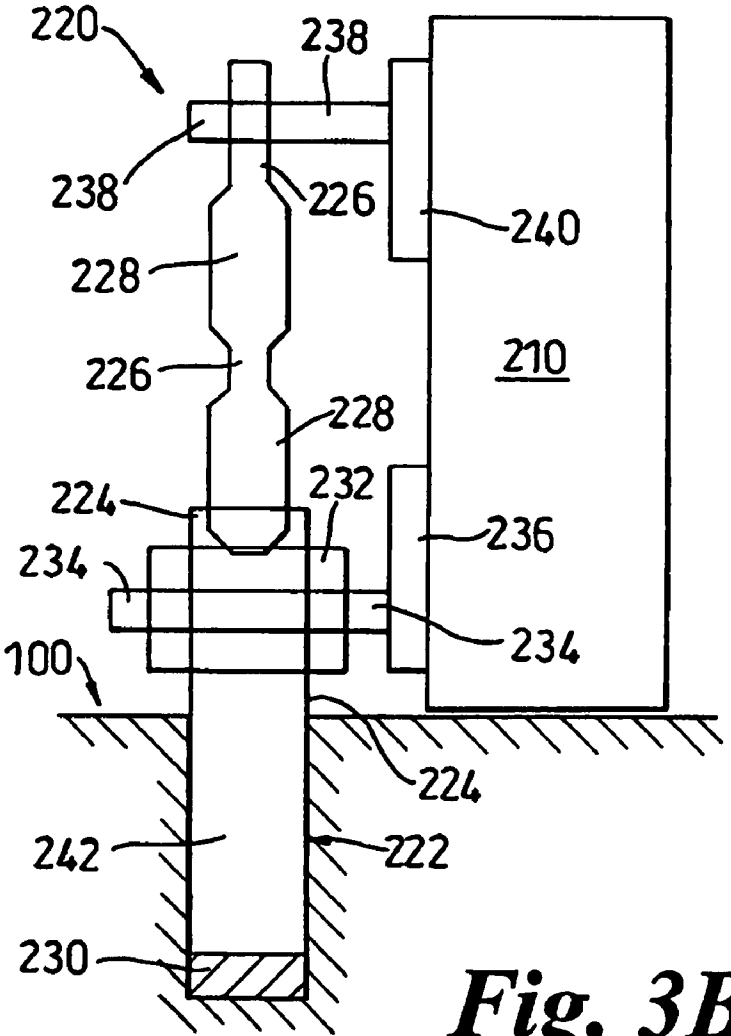
FIGS. 3A-3E are schematic representations of successive stages in the deployment of a second embodiment of seabed anchor in accordance with the invention from an ROV in order to anchor the ROV to adjacent seabed.
Figure 3A:
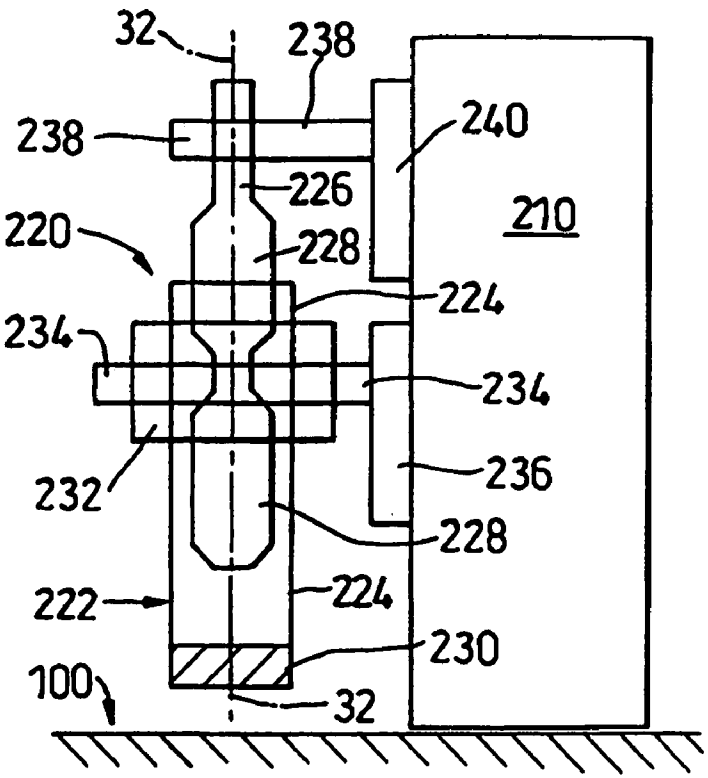

During cutting operation of the tubular drill 222 as schematically depicted in FIG. 3B, the tube 224 is rotated by the motor 232 and simultaneously forced downwards into the seabed 100 by controlled operation of the vertically adjustable mounting 236 to cause the bracket 234 to descend. As the tubular drill 222 cuts vertically downwards into the seabed 100, it forms a generally cylindrical bore 242. The core of seabed material formed by cutting operation of the tubular drill 222 can be removed from the bore 242 by any suitable means, for example by being broken into small fragments by impact with projecting blades (not shown per se) on the cutter 230, and washed out of the bore 242 by one or more jets of pressurised water (e.g. by exhaust from the motor 232 directed through nozzles (not shown) that are suitably located and suitably aligned).

Figure 3E:
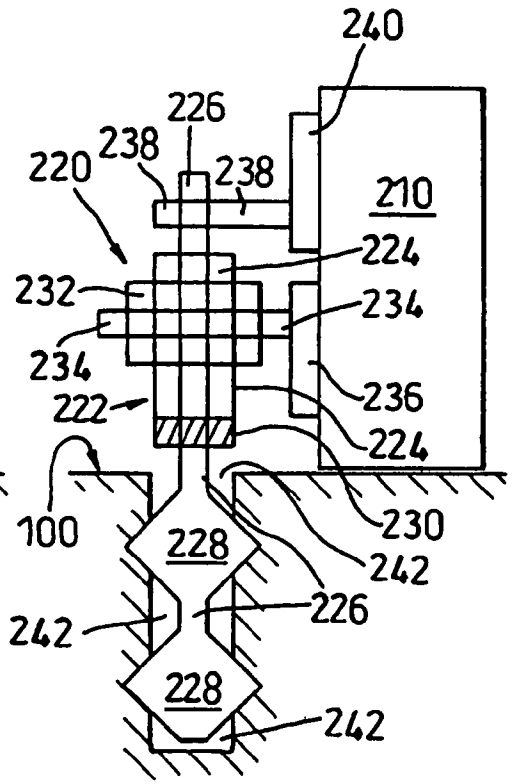
Figure 3D:
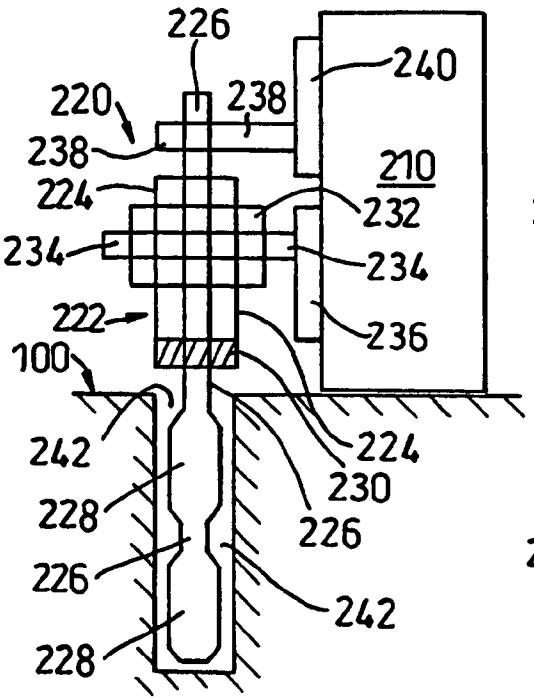
Figure 3C:
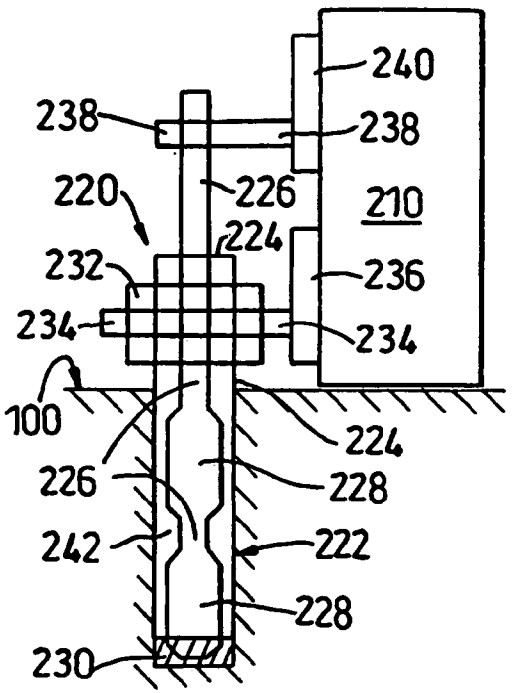

In the next stage of anchor deployment, as schematically depicted in FIG. 3C, the tube/packer assembly 226/228 is independently extended downwards into the bore 242 created by cutting operation of the tubular drill 222, either during cutting of the bore 242 or immediately following cutting of the bore 242. (The latter option is preferred as leaving the interior of the tubular drill 222 unobstructed for discharge of drilling debris from the bore 242.)

Once the bore 242 is drilled to its full depth and the tube/packer assembly 226/228 is extended to the bottom of the bore 242, the tubular drill 222 is withdrawn vertically upwards around the tube/packer assembly 226/228 while maintaining the tube/packer assembly 226/228 fully extended down into the bore 242, as schematically depicted in FIG. 3D. Withdrawal of the tubular drill 222 from around the tube/packer assembly 226/228 leaves the latter free for lateral extension of the packers 228 into the surrounding seabed material, as schematically depicted in FIG. 3E. This second embodiment of seabed anchor 220 is now set and usable as a seabed anchor for the ROV 210, or for any other submarine vehicle to which the anchor 220 is operatively attached.

Withdrawal from the seabed 100 of this alternative embodiment of seabed anchor 220 is accomplished by reversing the deployment steps schematically depicted in FIGS. 3A-3B, i.e. by laterally withdrawing the seabed engagement means (i.e. by deflating the packers 228) from the seabed around the bore 242, and then vertically collapsing the tube assembly 226 and operating the vertically adjustable mounting 240 so as to withdraw the tube/packer assembly 226/228 vertically upwards and out of the bore 242.

Figure 4A:
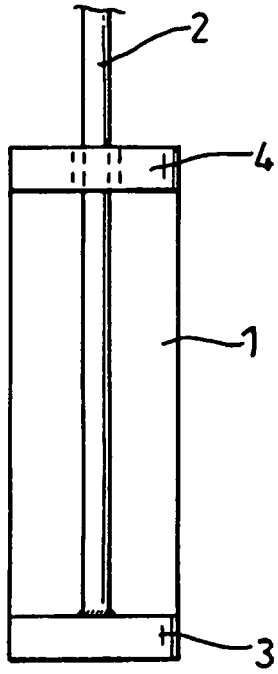
FIGS. 4A and 4B show an alternative type of packer assembly in a first, undeployed, position.
Figure 4B:
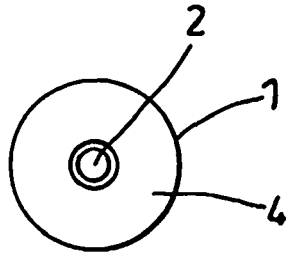
Figure 4C:
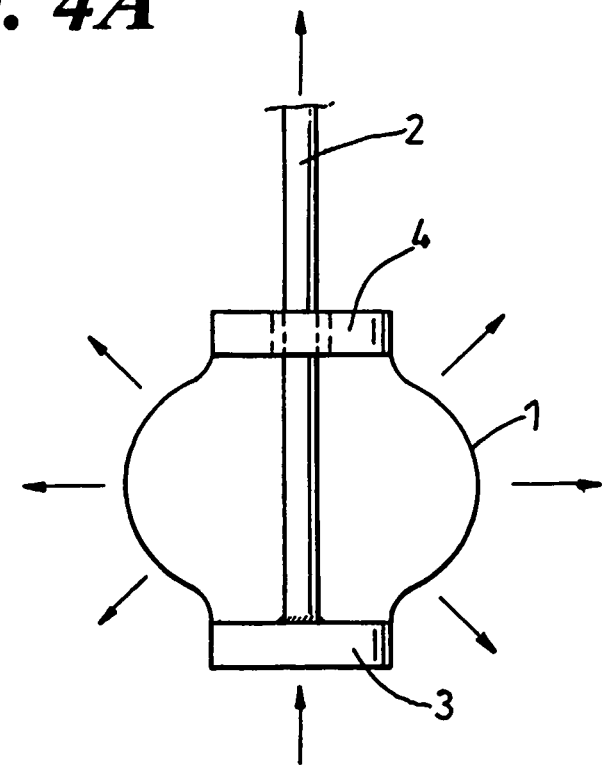
FIG. 4C shows the packer assembly of FIGS. 4A and 4B in a second, deployed position.

FIGS. 4A, 4B and 4C show a further type of packer assembly for use in the anchor. FIGS. 4A and 4B show the anchor in its undeployed position from the side and top respectively. This anchor consists of bladder 1, with caps 3 and 4 bonded at the bottom and top respectively. The top cap 4 has a hole in its centre for passing through a ram 2, the end of which is attached to the bottom cap 3. FIG. 4C shows the anchor in its deployed position. When the ram 2 is activated it moves upwards, pulling up the bottom cap 3 which moves relative to top cap 4, said top cap 4 acting as a fixed point. This results in the shortening of the bladder which curved outwards as a consequence (This curvature is exaggerated in FIG. 4C), creating a contact with the subsea materials. To aid this the transition from steel to rubber is shaped in a specific way.

The bladder travels into the hole in its elongated state FIG. 4A during the drilling operations, and is then activated as per FIG. 4C. The drill is placed in bottom of the hole in front of the bladder. The drill therefore remains in the hole at all times.

To remove the anchor, the ram 2 is used to simply return the bladder 1 to its original position, that is ram 2 is used to return the extended bladder to be the same size as the drilled out hole. When it is extended, the bladder elongates in the long axis and releases its contact with the sub-soil walls.

It is advantageous for the hole in the cap 4 to have fitted a scraper or brush to prevent/reduce ingress of mud etc. which will be present as a result of the drilling and water flushing operations.

As well as being applied to an ROV, as that term is understood in a narrow sense, seabed anchors in accordance with the invention can be fitted on other underwater vehicles, e.g. manned submersibles, seabottom crawlers, variable buoyancy lifting bodies, and movable platforms generally. Considering the invention in its broader sense as an anchor for vehicles (and for other mobile entities), the anchor of the invention can be applied to vehicles (or other mobile entities) in general, whether for use underwater or in non-aqueous environments, whether the vehicle or other mobile entity is exploratory, investigative, freight-carrying, passenger-carrying, commercial, recreational, civilian, military, or for any other purpose.

Other modifications and variations can be adopted without departing from the spirit and scope of the invention as defined in the appended claims.

The invention claimed is:

1. A combination of a vehicle with at least one anchor comprising drill means operable to drill into ground adjacent the vehicle to form a hollow bore in the ground, the anchor further comprising ground-engaging means operable within the bore formed by the drill means to extend laterally to engage the ground and thereby to resist separation of the vehicle from the ground, wherein the vehicle comprises a remotely operated vehicle (ROV) adapted for seabed operations.

2. A combination as claimed in claim 1, wherein the anchor is specifically adapted for underwater use, the ground in that case comprising seabed or the like.

3. A combination as claimed in claim 1, wherein the ground-engaging means is integral with the drill means, and the drill means and the ground-engaging means are cooperable so as to avoid the need to retract the drill means from the bore prior to inserting the ground-engaging means into the bore formed by the drill means, whereby the drill means and ground-engaging means are adapted to enter and remain together in the bore while the ground-engaging means is deployed to engage the wall of the bore.

4. A combination as claimed in claim 1, wherein the ground-engaging means is non-integral with the drill means, and wherein the drill means is adapted to be withdrawn from the bore formed by the drill means, leaving the ground-engaging means to engage the wall of the bore.

5. A combination as claimed in claim 4, wherein the ground-engaging means is arranged to travel into the bore during drilling, or after drilling, but prior to withdrawal of the drill means from the bore formed by the drill means.

6. A combination as claimed in claim 1, wherein positive withdrawal means are provided for controllably effecting positive withdrawal of the ground-engaging means from substantial engagement with ground around the bore in which the ground-engaging means is deployed as a stage in withdrawal of the anchor from the ground, whereby to obviate or minimise risk of the anchor remaining stuck in the ground.

7. A combination as claimed in claim 1, wherein the ground-engaging means is disengagable by remote control, for selective release of the anchor from the ground.

8. A combination as claimed in claim 1, wherein the anchor provides for deployment and subsequent retraction at a succession of locations without human intervention, either by suitable programming of an on-board computer controlling exploration by an ROV or other vehicle on which the anchor is operatively mounted.

9. A combination as claimed in claim 8, wherein the anchor is provided with remotely operable decoupling means or a simple "weak link" for decoupling the vehicle from the anchor in the event that the anchor should fail to disengage from the seabed or other ground in which the anchor is engaged.

10. A combination as claimed as in claim 1, wherein the vehicle comprises a survey vehicle including at least one investigatory tool deployable against the ground using reaction force provided by the anchor.

11. A combination as claimed in claim 10, wherein the investigatory tool comprises an instrument operable to measure mechanical properties of the ground.

12. A combination as claimed in claim 10 wherein the investigatory tool comprises a sampling tool, the ground properties being measured by analysis of a sample of ground material recovered by the tool.

13. A combination as claimed in claim 10, wherein measurement of ground properties is augmented or substituted by measurement of the power or energy or force required to cause the ground-engaging means laterally to extend from within a bore to engage ground around the bore formed and occupied by the anchor.

14. A combination as claimed in claim 13, wherein cohesion of the soil is inferred from the pressure necessary to inflate inflatable packers constituting the laterally extendible ground-engaging means.

15. A combination as claimed in claim 1, said anchor including instrumentation for outputting information on conditions within the bore formed by the drill means.

16. A combination as claimed in claim 1, wherein the drill means comprises a rotary drill bit and a drill-driving rotary motor coupled to the drill bit.

17. A combination as claimed in claim 16, wherein the drill-driving rotary motor is located at an upper extremity of the drill means.

18. A combination as claimed in claim 16, wherein the drill-driving rotary motor is a hydraulic rotary motor powered in use by pressurised liquid.

19. A combination as claimed in claim 18, wherein the pressurised liquid is ambient water.

20. A combination as claimed in claim 19, wherein water leaving the motor after powering the motor is discharged in a manner tending to flush drilling debris away from the drill bit and out of the bore being drilled by the drill means.

21. A combination as claimed in claim 1, wherein the ground-engaging means comprises one or more flexible packers or flexible membranes normally quiescent in a deflated configuration and inflatable to extend laterally into engagement with the ground around the bore in which the ground-engaging means is deployed.

22. A combination as claimed in claim 21, wherein inflation of the one or more flexible packers or flexible membranes is accomplished by controlled admission thereto of pressurised fluid.

23. A combination as claimed in claim 22, wherein the pressurised fluid is ambient water.

24. A combination as claimed in claim 1 wherein the ground engaging means comprises a bladder wherein pressure applied to said bladder in a longitudinal direction results in expansion of the bladder in a transverse direction and therefore engaging with the ground.

25. A combination as claimed in claim 24 wherein the ground engaging means wherein said bladder is activated by a ram.

26. A combination as claimed in claim 25 wherein said ram extends into and is attached to a lower part of said bladder and wherein when a force is applied to move said ram in an upward direction, the bottom of said bladder moves upwards relative to the top of the bladder resulting in the body of the bladder extending transversely thus engaging the ground.

27. A combination as claimed in claim 25 wherein said bladder is cylindrical in shape, with steel cap bottom and top, the latter cap having a hole to allow the ram to extend into the bladder.

28. A combination as claimed in claim 1, wherein the ground-engaging means comprises one or more mechanical packers or flukes or wedges, the or each of which is displaceable from a respective normally quiescent position withdrawn from substantial engagement with the wall of the bore in which the ground-engaging means is deployed, to a respective laterally extended position so as to engage the ground around the bore.

29. A combination as claimed in claim 1, wherein the ground-engaging means is disposed to engage the bore at a plurality of locations distributed circumferentially around and/or axially along the bore within which the ground-engaging means is deployed in use.

30. A combination as claimed in claim 1, wherein the anchor is provided with alternative forms of ground-engaging means, together with substitution means for substituting these alternative forms according to ground type and intended application of the vehicle.

31. A combination as claimed in claim 1, wherein the vehicle is combined with a plurality of said anchors that are mutually spaced apart to anchor the vehicle to adjacent ground at a corresponding plurality of spaced-apart locations and thereby increase the resistance of the vehicle to toppling in response to upward reaction forces arising from use of geotechnical investigatory tools or sensors mounted on the vehicle.

32. A combination as claimed as claimed in claim 1, wherein hydraulic power and/or other forms of power for operating the anchor or parts thereof is obtained from a power supply or supplies forming an integral part of the vehicle.

33. A combination as claimed in claim 32, wherein the power supply is a seawater pump driven by an electric motor powered by batteries on board an ROV or powered by electricity delivered to an ROV via a cable.

34. A combination as claimed in claim 1, wherein the anchor or anchors provide a reaction force greater than can be provided by an upwardly discharging propulsive/maneuvering thrusters mounted on the ROV, or by vehicular weight alone.

35. A method of anchoring a vehicle to adjacent ground, the method comprising the steps of providing the vehicle with an anchor having drill means and ground-engaging means, operating the drill means of the anchor to drill into ground adjacent the vehicle to form a hollow bore in the adjacent ground, and then operating the ground-engaging means within said bore to engage the ground thereby to anchor the vehicle to the ground; wherein said vehicle includes an underwater ROV (Remotely Operated Vehicle), a manned submersible, or a variable buoyancy lifting body.

36. A method as claimed in claim 35, wherein the method is performed without retracting the drill means from the bore formed by the drill means, prior to inserting the ground-engaging means into said bore.

37. A method as claimed in claim 36, wherein the drill means and the ground-engaging means enter and remain together in the bore while the ground-engaging means is deployed to engage the wall of the bore.

38. A method as claimed in claim 36, wherein the drill means is withdrawn from the bore after forming the bore, leaving the ground-engaging means within said bore to engage the wall of the bore.

39. A method as claimed in claim 38, wherein the ground-engaging means is deployed into said bore during drilling, or after drilling.

40. A method as claimed in claim 39, wherein the ground-engaging means is deployed into said bore prior to withdrawal of the drill means from the bore formed by the drill means.

41. A method as claimed in claim 38, wherein the vehicle is provided with a plurality of such anchors that are mutually spaced apart to anchor the vehicle to adjacent ground at a corresponding plurality of spaced-apart locations.

42. A method as claimed in claim 35, wherein hydraulic power and/or other forms of power for operating the anchor or parts thereof is provided to the or each anchor from a power supply or supplies forming an integral part of the vehicle.

43. A method as claimed in claim 42, wherein the power supply is a seawater pump driven by an electric motor powered by batteries on board the vehicle or powered by electricity delivered to the vehicle via a cable.

44. A method as claimed in claim 35, wherein the method comprises a further step of performing a measurement of ground properties at a selected location on the ground using a geotechnical investigatory tool carried by the vehicle to the selected location, the vehicle then being anchored to the ground at the selected location, and the investigatory tool being driven into the ground against a reaction force provided by the anchor or anchors.

45. A method as claimed in claim 35, wherein the method further includes deriving measurements of geotechnical properties of the ground from measurements of parameters of the ground-engaging means, during deployment thereof.

* * * * *